US009051716B2

(12) United States Patent
Bricker et al.

(10) Patent No.: US 9,051,716 B2
(45) **Date of Patent: *Jun. 9, 2015**

(54) ZERO OFFSET LOADER COUPLING SYSTEM AND COMPONENTS

(75) Inventors: Adam Bricker, North Canton, OH (US); Anthony Seda, Akron, OH (US); Robert Sikorski, Tallmadge, OH (US)

(73) Assignee: Paladin Brands Group, Inc., Oak Brook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/584,255

(22) Filed: Aug. 13, 2012

(65) Prior Publication Data

US 2013/0045073 A1 Feb. 21, 2013

Related U.S. Application Data

(63) Continuation of application No. 12/436,350, filed on May 6, 2009, now Pat. No. 8,240,970.

(60) Provisional application No. 61/051,172, filed on May 7, 2008.

(51) Int. Cl.
*E02F 3/36* (2006.01)
*E02F 3/34* (2006.01)

(52) U.S. Cl.
CPC ..... *E02F 3/3411* (2013.01); *Y10T 403/24* (2015.01); *Y10T 403/18* (2015.01); *E02F 3/3636* (2013.01); *E02F 3/3622* (2013.01); *E02F 3/3631* (2013.01); *E02F 3/3663* (2013.01)

(58) Field of Classification Search
CPC ..... E02F 3/3622; E02F 3/3663; E02F 3/3631; E02F 3/3411; E02F 3/3636
USPC ..... 414/697, 700, 723; 172/272–275; 37/468
See application file for complete search history.

(56) References Cited

U.S. PATENT DOCUMENTS

| | | | |
|---|---|---|---|
| 3,243,066 | A | 3/1966 | Gardner et al. |
| 3,272,264 | A | 9/1966 | Antolini |
| 3,705,656 | A | 12/1972 | Hunger et al. |

(Continued)

FOREIGN PATENT DOCUMENTS

| | | |
|---|---|---|
| EP | 0 580 000 | 7/1993 |

OTHER PUBLICATIONS

International Search Report mailed Jun. 26, 2009 for International application No. PCT/US2009/042978.

(Continued)

*Primary Examiner* — Scott Lowe
(74) *Attorney, Agent, or Firm* — Fay Sharpe LLP

(57) ABSTRACT

A loader coupling system includes an arm coupler and a link coupler. The arm coupler includes first and second plunger pins located respectfully at opposite first and second ends of the body. At least one plunger actuator is operatively connected to the first and second plunger pins, and the plunger actuator is selectively operative to move the first and second plunger pins between a retracted position and an extended position. The link coupler includes a tilt link with a first end adapted to be pivotally connected to a control link of the associated loader machine and a second end including a hook adapted to selectively engage and retain a cross-pin of the associated attachment. A lock system is connected to the tilt link and is adapted to selectively capture the cross-pin of the associated attachment in the hook.

7 Claims, 15 Drawing Sheets

(56) References Cited

U.S. PATENT DOCUMENTS

| | | | |
|---|---|---|---|
| 3,760,883 | A | 9/1973 | Birk |
| 4,116,347 | A | 9/1978 | Uchida |
| 4,179,225 | A | 12/1979 | Asplund |
| 4,203,238 | A | 5/1980 | Bangert et al. |
| 4,208,163 | A | 6/1980 | Holmqvist |
| 4,243,356 | A | 1/1981 | Takojima |
| 4,586,867 | A | 5/1986 | Stafford |
| 4,643,631 | A | 2/1987 | Mauer et al. |
| 4,708,579 | A | 11/1987 | Baird et al. |
| 4,812,103 | A | 3/1989 | Cochran et al. |
| 4,963,071 | A | 10/1990 | Larwin et al. |
| 4,984,957 | A | 1/1991 | Noguchi et al. |
| 4,986,722 | A | 1/1991 | Kaczmarczyk et al. |
| 5,049,027 | A | 9/1991 | Morrison et al. |
| 5,088,882 | A | 2/1992 | Lovitt, Jr. et al. |
| 5,310,275 | A | 5/1994 | Lovitt |
| 5,415,235 | A | 5/1995 | Gebauer |
| 5,529,419 | A | 6/1996 | Gebauer |
| 5,546,683 | A | 8/1996 | Clark |
| 5,581,917 | A | 12/1996 | Barden |
| 5,590,483 | A | 1/1997 | Kim |
| 5,685,689 | A | 11/1997 | Schneider et al. |
| 5,692,850 | A | 12/1997 | Kimble et al. |
| 5,732,488 | A | 3/1998 | Smith |
| 5,820,332 | A | 10/1998 | Philips et al. |
| 5,865,594 | A | 2/1999 | Kim |
| 6,058,633 | A | 5/2000 | Barden |
| 6,196,595 | B1 | 3/2001 | Sonerud |
| 6,227,792 | B1 | 5/2001 | Baker et al. |
| 6,241,455 | B1 | 6/2001 | Schupback et al. |
| 6,308,442 | B1 | 10/2001 | Naka et al. |
| 6,332,747 | B1 | 12/2001 | Lee |
| 6,386,822 | B1 | 5/2002 | Burr |
| 6,438,875 | B1 | 8/2002 | Kimble et al. |
| 6,533,528 | B2 | 3/2003 | Degen et al. |
| 6,860,706 | B2 | 3/2005 | Godwin et al. |
| 6,886,279 | B2 | 5/2005 | Kimble |
| 6,899,509 | B1 | 5/2005 | Mailleux |
| 6,991,398 | B2 | 1/2006 | Leemans et al. |
| 6,996,926 | B2 | 2/2006 | Fatemi |
| 7,014,385 | B2 | 3/2006 | Lim et al. |
| 7,168,908 | B2 | 1/2007 | Diaz et al. |
| 7,182,546 | B1 | 2/2007 | Kimble |
| 7,225,566 | B1 | 6/2007 | Kimble |
| 7,337,564 | B2 | 3/2008 | Kimble |
| 7,364,181 | B2 | 4/2008 | Patterson |
| 2004/0076504 | A1 | 4/2004 | Geraghty |
| 2007/0128014 | A1 | 6/2007 | Krieger |
| 2008/0141566 | A1 | 6/2008 | Esser et al. |
| 2009/0110530 | A1 | 4/2009 | Harshberger et al. |

OTHER PUBLICATIONS

Written Opinion mailed Jun. 26, 2009 for International application No. PCT/US2009/042978.

International Preliminary Report mailed Nov. 18, 2010 for International application No. PCT/US2009/042978.

ZERO OFFSET LOADER COUPLING SYSTEM AND COMPONENTS

CROSS-REFERENCE TO RELATED APPLICATION

This application is a continuation of U.S. application Ser. No. 12/436,350 filed May 6, 2009, which is now assigned U.S. Pat. No. 8,240,970 and which claims priority from and benefit of the filing date of U.S. provisional application Ser. No. 61/051,172 filed May 7, 2008, and the entire disclosure of each said prior application is hereby expressly incorporated by reference into the present specification.

BACKGROUND

Couplers of front-end loaders and like loader machines are known and typically comprise a body that is pivotally connected to first and second loader arm and that is also pivotally connected to one or more control links of the loader machine. The coupler is selectively mated with first and second spaced-apart ribs of an associated attachment such as a bucket or the like, and a lock system is provided for capturing the ribs of the associated attachment to the coupler body. These couplers have enjoyed widespread commercial success and are well-known in the art and provide a large benefit over conventional pin-on connection of the attachment to the loader arms and control link(s).

One drawback associated with such couplers is that the presence of the coupler body between the attachment and the loader arms and control link(s) of the loader machine alters the geometry of the relationship between the loader arms and control link(s) as compared to the original equipment (OE) specifications for direct pin-on pivoting connection of the attachment to the loader arms and control link(s). The coupler body also adds weight to the outer ends of the loader arms and can reduce operator visibility for certain types of attachments, e.g., forks or the like.

Accordingly, it has been deemed desirable to provide a new coupler and coupling system.

SUMMARY

In accordance with one aspect of the present development, a loader coupling system includes an arm coupler and a link coupler each adapted to mate with an associated attachment. The arm coupler includes a body adapted to be connected to and extend between first and second spaced-apart arms of an associated loader machine. First and second plunger pins are located respectfully at opposite first and second ends of the body. At least one plunger actuator is operatively connected to the first and second plunger pins, and the at least one plunger actuator is selectively operative to move the first and second plunger pins between a retracted position and an extended position. The first and second plunger pins project outward from the respective first and second opposite ends of the body a greater distance in the extended position as compared to the retracted position, wherein the first and second plunger pins are adapted to extend into apertures defined in first and second arm attachment ribs of the associated attachment, respectively, when the first and second plunger pins are located in the extended position. The link coupler includes a tilt link with a first end adapted to be pivotally connected to a control link of the associated loader machine and a second end including a hook adapted to selectively engage and retain a cross-pin of the associated attachment. A lock system is connected to the tilt link and is adapted to selectively capture the cross-pin of the associated attachment in the hook.

In accordance with another aspect of the present development, a method of connecting a coupler to a loader machine includes inserting first and second loader arm ends into first and second loader arm receiving areas of a coupler body. An inner end of a first plunger pin is inserted through a first plunger aperture of the coupler body and the inner end of the first plunger pin is slid through an arm aperture defined in the first loader arm end. An inner end of a second plunger pin is inserted through a second plunger aperture of the coupler body and the inner end of the second plunger pin is slid through an arm aperture defined in the second loader arm end. The inner ends of the first and second plunger pins are operatively connected to respective actuator rods of a plunger actuator system such that said first and second plunger pins capture the first and second loader arm ends in the first and second loader arm receiving areas of the coupler body, respectively.

In accordance with another aspect of the present development, a loader coupling system includes an arm coupler and a link coupler each adapted to mate with an associated attachment. The arm coupler includes a body connected to and extending between first and second spaced-apart arms of a loader machine. First and second plunger pins are located respectfully at opposite first and second ends of the body. At least one plunger actuator is operatively connected to the first and second plunger pins and is selectively operative to move the first and second plunger pins between a retracted position and an extended position. The first and second plunger pins project outward from the respective first and second opposite ends of the body a greater distance in the extended position as compared to the retracted position, wherein the first and second plunger pins are adapted to extend into apertures defined in first and second arm attachment ribs of the associated attachment, respectively, when the first and second plunger pins are located in their extended positions. The link coupler includes a tilt link including a first end pivotally connected to a control link of the loader machine and a second end including a hook adapted to selectively engage and retain a cross-pin connected to the associated attachment. The link coupler also includes a lock system including a lock member for selectively capturing the cross-pin in the hook.

In accordance with another aspect of the present development, a coupler for releasably connecting an associated attachment to first and second spaced-apart loader arms of an associated loader machine includes a body adapted to be connected to and extend between first and second spaced-apart arms of an associated loader machine. First and second plunger pins are located respectfully at opposite first and second ends of said body. At least one plunger actuator is supported on the body and is operatively connected to the first and second plunger pins. The at least one plunger actuator is selectively operative to move the first and second plunger pins between a retracted position and an extended position. Respective outer ends of the first and second plunger pins project outward from the respective first and second opposite ends of the body such that first distance is defined between the outer ends of the first and second plunger pins when the first and second plunger pins are in their extended positions. A second distance that is less than the first distance is defined between the outer ends of the first and second plunger pins when the first and second plunger pins are moved to their retracted positions.

In accordance with another aspect of the present development, a construction attachment includes an attachment body for performing work. First and second vertical spaced-apart arm attachment ribs are connected to a rear face of the attachment body. The first and second arm attachment ribs include respective first and second apertures extending therethrough and adapted to receive respective first and second plunger pins of a first associated coupler component. A cross-pin is connected to the body centrally between the first and second arm attachment ribs. The cross-pin is spaced vertically above the first and second apertures and adapted to be engaged by a hook of a second associated coupler component.

In accordance with another aspect of the present development, a loader coupling system includes at least one arm coupler system including first and second plunger pins respectfully connected to first and second spaced-apart loader arm ends of an associated loader machine. First and second plunger actuators are operatively connected to the first and second plunger pins. The first and second plunger actuators are selectively operative to move the first and second plunger pins between a retracted position and an extended position, wherein a first distance is defined between outer ends of the first and second plunger pins when the first and second plunger pins are in their extended positions and a second distance is defined between the outer ends of the first and second plunger pins when the first and second plunger pins are in their retracted positions, wherein said second distance is less than said first distance and the first and second plunger pins are adapted to be received into respective apertures of first and second arm attachment ribs of an associated attachment when the first and second plunger pins are located in their extended positions.

In accordance with another aspect of the present development, a method of connecting an attachment to a loader machine includes positioning first and second loader arm ends respectively adjacent first and second arm attachment ribs of an attachment. The method further includes using at least one hydraulic actuator to move first and second plunger pins that are respectively connected to the first and second loader arm ends from a retracted position to an extended position, such that the first and second plunger pins are respectively inserted into apertures of the first and second arm attachment ribs. A tilt link is positioned such that a cross-pin of the attachment is received in an hook located at a second end of the tilt link, wherein a first end of the tilt link is pivotally connected to a control link of the loader machine and wherein the positioning includes using a hydraulic actuator to vary the angular position of the tilt link relative to the control link. A hydraulic lock actuator connected to the tilt link is operated to move a lock member from an unlocked position to a locked position, wherein the lock member captures the attachment cross-pin in the hook when the lock member is in its locked position.

DETAILED DESCRIPTION

Figure 1:
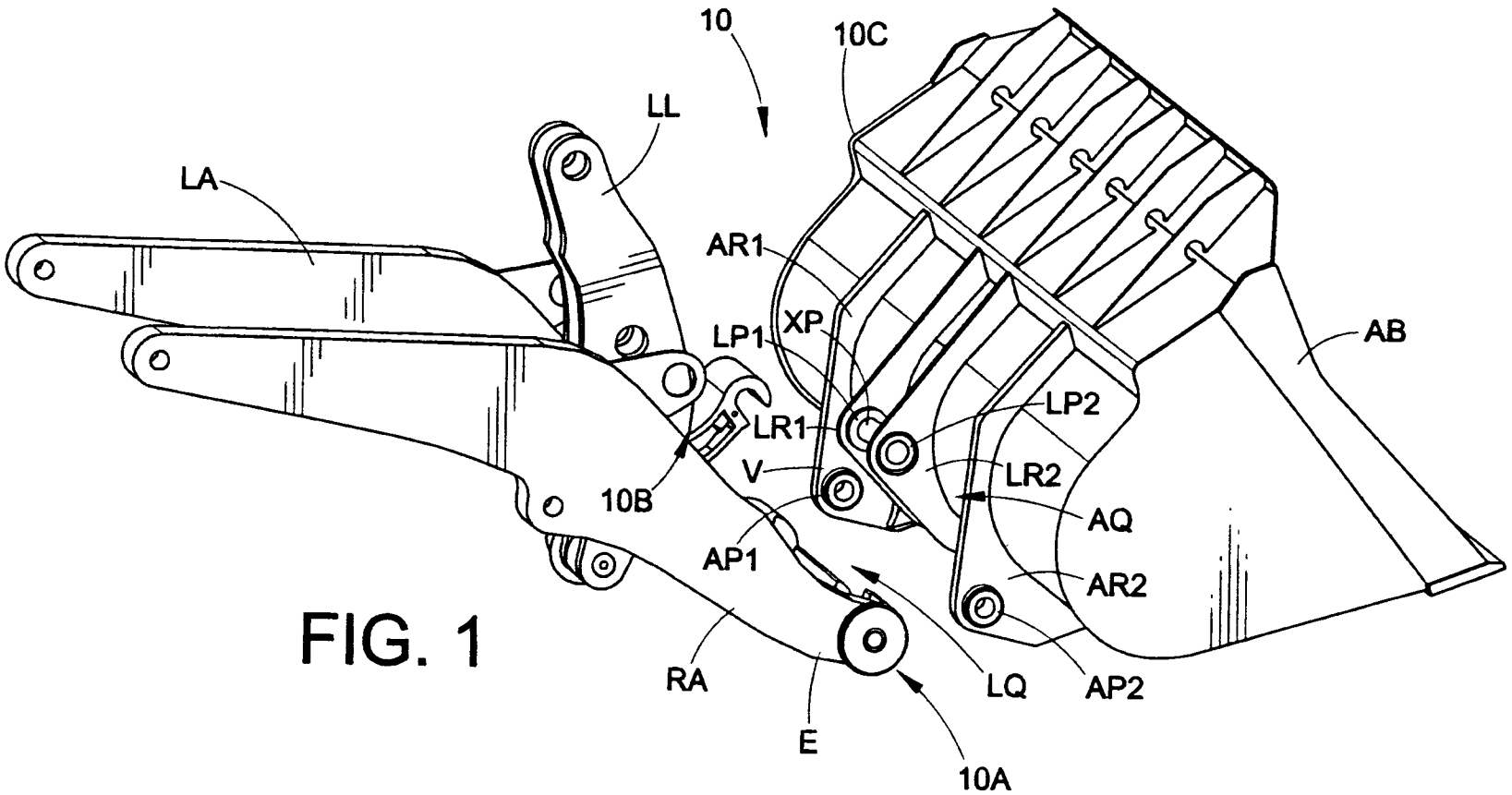
FIGS. 1 and 2 are isometric views of a zero offset loader coupling system formed in accordance with the present development.
Figure 2:
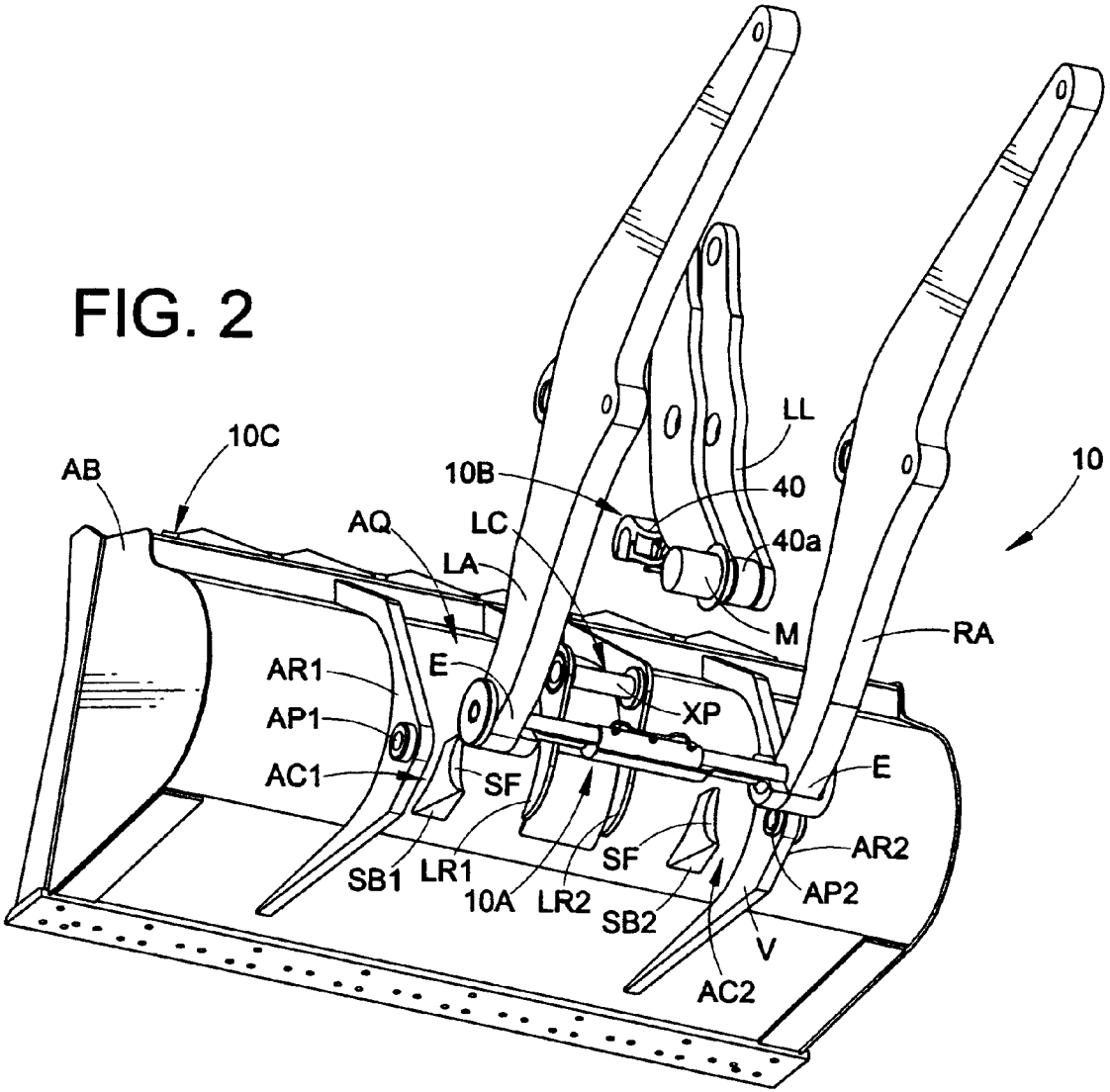
Figure 3:
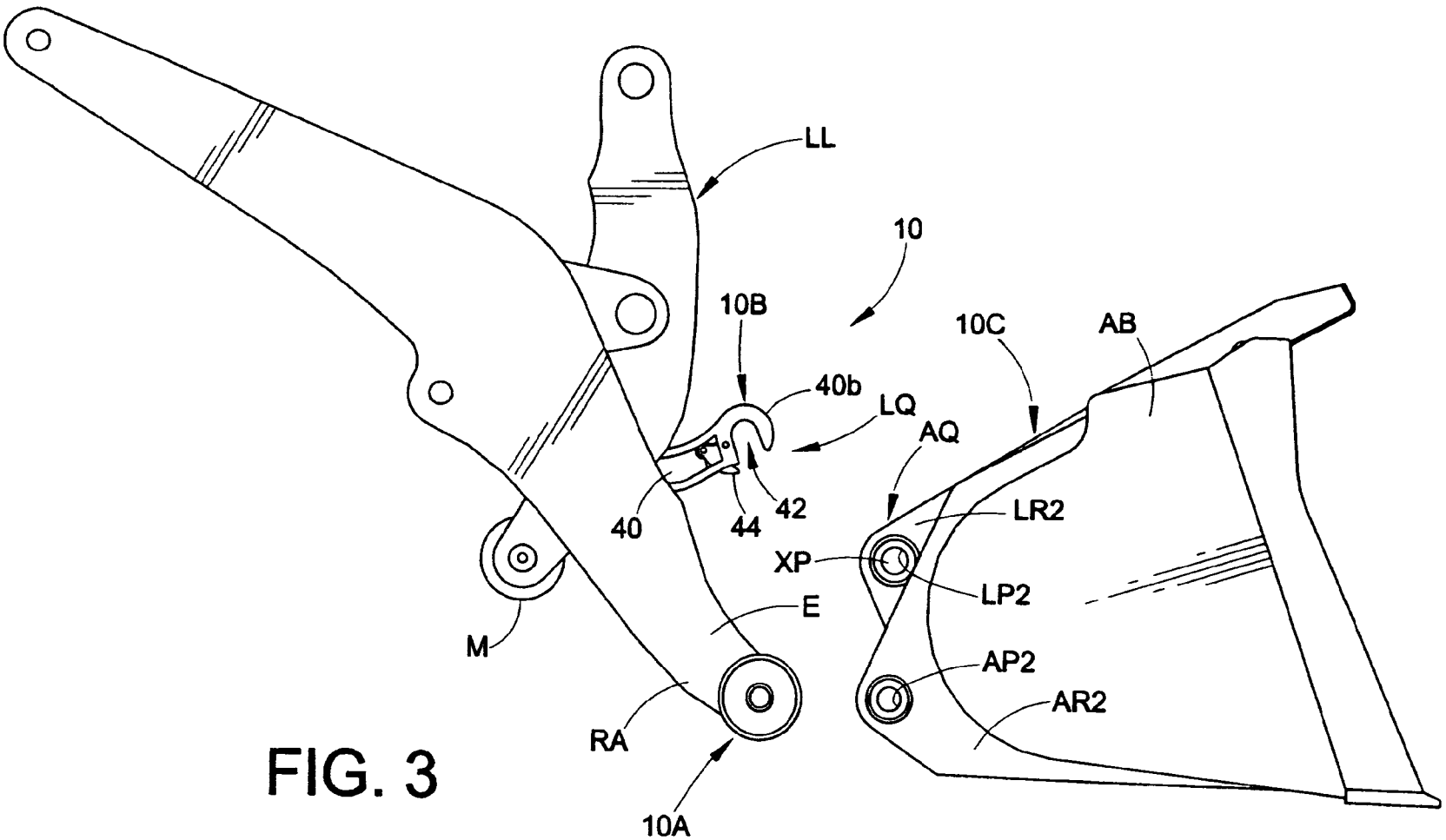
FIG. 3 is a right side view of the loader coupling system of FIGS. 1 and 2.

FIGS. 1 and 2 are isometric views and FIG. 3 is a right side view of a zero offset loader coupling system 10 formed in accordance with the present development. The system 10 comprises an arm coupler 10A and a link coupler 10B, that together define a loader-side coupling system LQ. The system 10 further comprises an attachment-side coupling system or structure AQ connected to an attachment body AB to define an attachment 10C. The attachment body AB is shown herein as a bucket, but the attachment body can be any other known attachment such as forks, a blade or plow, a grapple, or the like. As described herein, the loader-side coupling system LQ and attachment-side coupling structure AQ are configured to allow the attachment 10C to be selectively operably connected to left and right arms LA,RA and at least one control link LL of an associated loader machine, such as a wheel loader, backhoe, tractor, or the like machine comprising the left and right arms LA,RA and at least one control link LL (note that in the present example, the control link LL comprises a pair of parallel link members; the left and right arms LA,RA and control link LL can be one-piece or multi-piece structures). As described below, the zero offset loader coupling system 10 operably secures the attachment body AB to the loader arms LA,RA and control link LL in a relationship that matches, or alters if desired for performance reasons, the loader original equipment manufacturer (OEM) specified conventional pin-on connection for a pin-on attachment of the same size and type as the attachment body AB.

The attachment-side coupling structure AQ comprises first (left) and second (right) vertical arm ribs AR1,AR2 that are arranged parallel and spaced-apart relative to each other. The attachment-side coupling structure AQ further comprises first (left) and second (right) vertical link ribs LR1,LR2 that are arranged parallel and spaced-apart relative to each other, located between the arm ribs AR1,AR2 (the mid-point between the link ribs LR1,LR2 is preferably coincident with the mid-point between the arm ribs AR1,AR2).

The arm ribs AR1,AR2 comprise respective inner vertical faces V. The arm ribs AR1,AR2 further comprise respective horizontal apertures AP1,AP2 that are aligned with each other. Likewise, the link ribs LR1, LR2 comprise respective horizontal apertures LP1,LP2 that are aligned with each other. A link cross-pin XP is inserted and secured in the link rib apertures LP1,LP2 so that the cross-pin XP extends between the link ribs LR1,LR2. The cross-pin XP can comprise a non-rotatable pin that extends between the link ribs LR1,LR2 and an external rotatable sleeve that is coaxially mounted about the non-rotatable pin. The rotatable sleeve can be a greased part or a never-grease type rotatable sleeve.

The attachment 10C further comprises first (left) and second (right) stop blocks SB1,SB2 (FIG. 2) located between the first and second arm ribs AR1,AR2, with the first stop block SB1 being located near and associated with the first arm rib AR1 and the second stop block SB2 being located near and associated with the second arm rib AR2. Each stop block SB1,SB2 comprises an outer concave arcuate or cylindrical stop surface SF. The arc centers of the radiused surfaces SF coincident with the centers of the arm rib apertures AP1,AP2. The first arm rib AR1 and stop block SB1 define first arm coupling structure/location AC1, and the second arm rib AR2 and stop block SB2 define a second arm coupling structure/location AC2. The first and second link ribs LR1,LR2 and cross-pin XP cooperate to define a link coupling structure/location LC between the link ribs. The first and second arm coupling structures/locations AC1,AC2 and the link coupling structure/location LC together define the attachment-side coupling structure AQ that is connected to the attachment body AB (shown herein as a bucket), to define the attachment 10C.

Figure 2A:
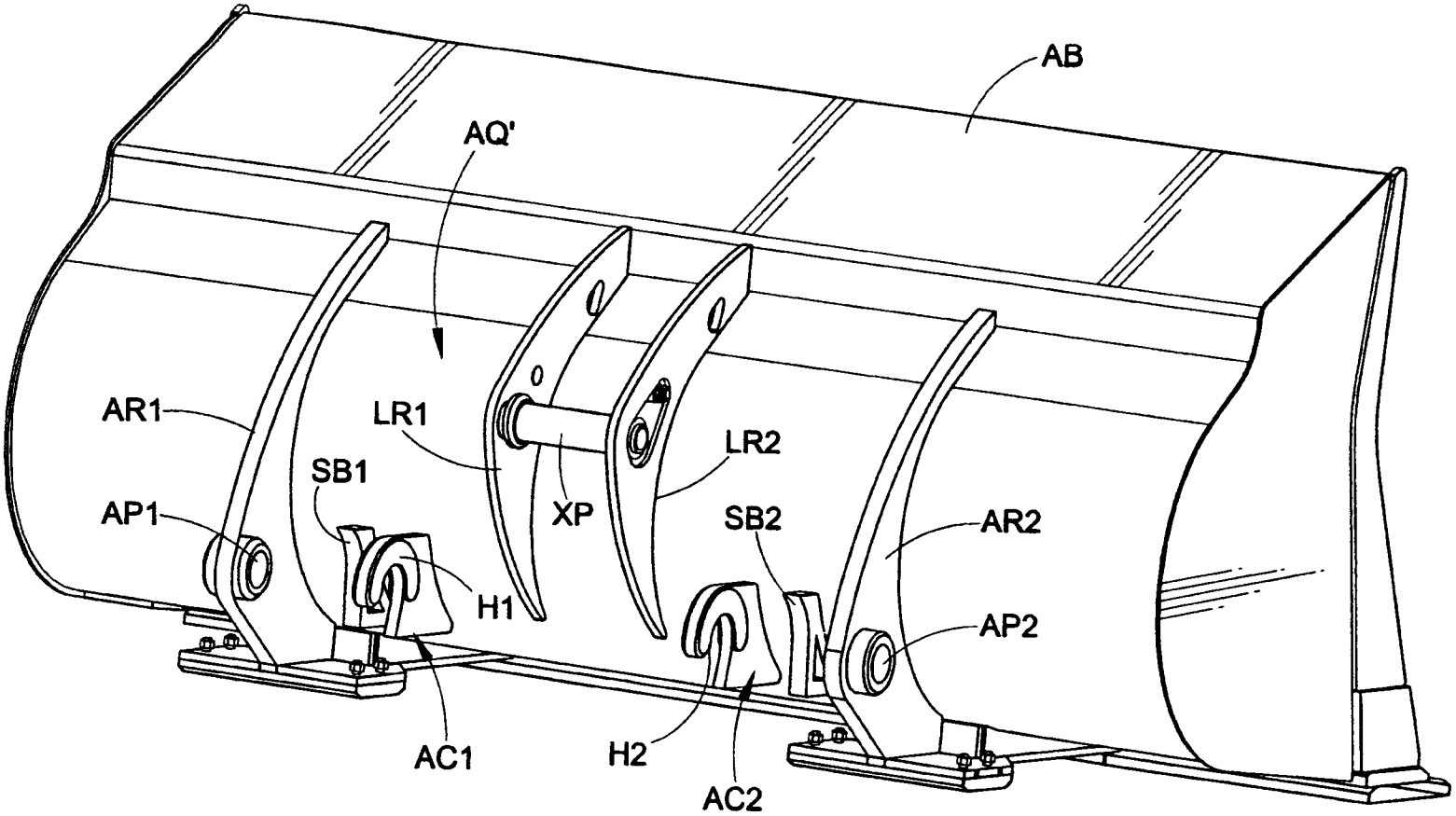
FIG. 2A shows an alternative attachment-side coupling structure.

FIG. 2A shows an alternative attachment-side coupling structure AQ' that is identical to the attachment-side coupling structure AQ, except that it further includes first and second hooks H1,H2 located respectively adjacent and inward from the first and second stop blocks SB1,SB2. Otherwise, like components between the structures AQ and AQ' are identified with like reference characters. The hooks H1,H2 engage the arm coupler 10A of the loader-side coupling structure to distribute loads more evenly, e.g., when the attachment AB is being pulled or dragged rather than pushed.

Figure 4:
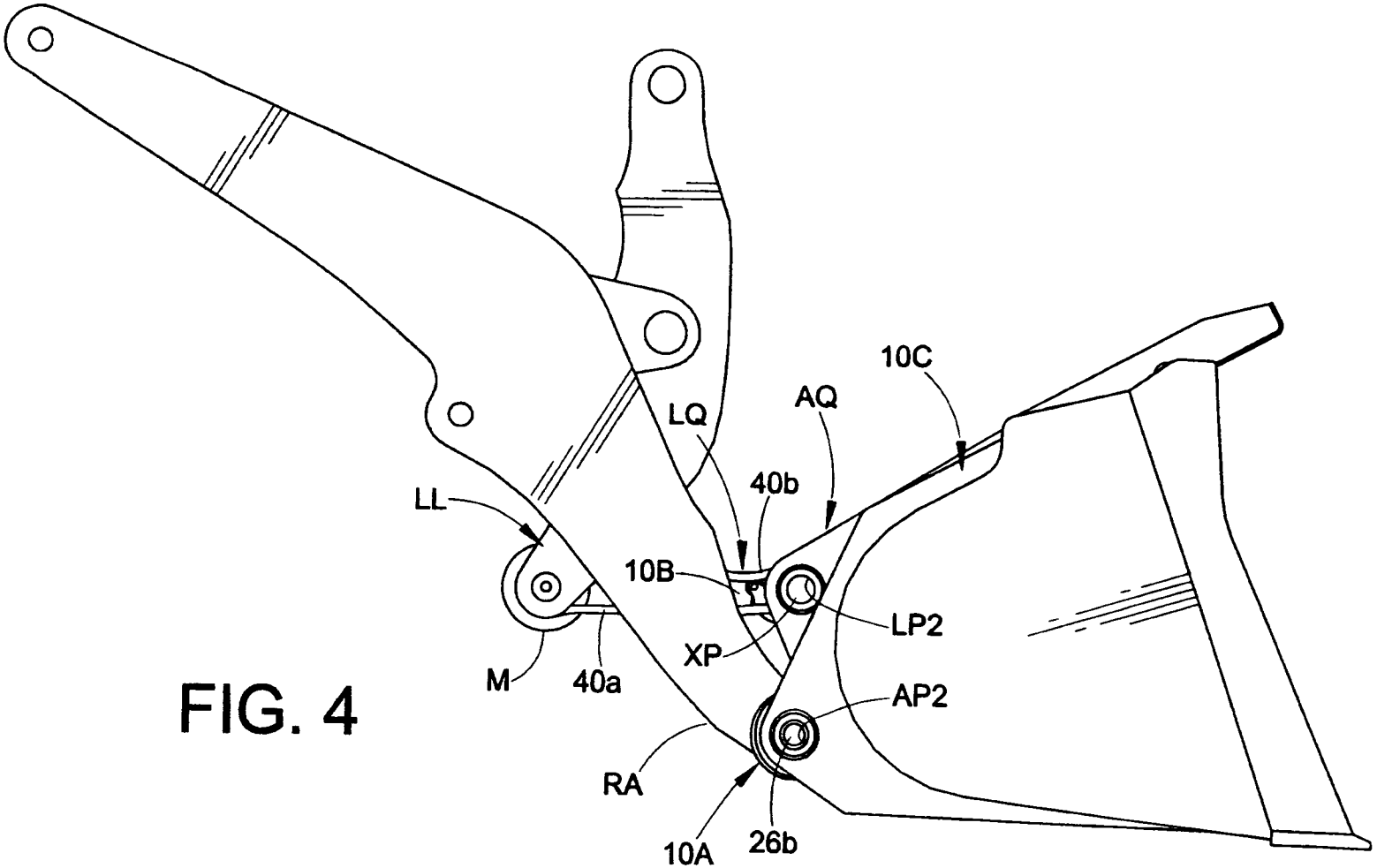
FIG. 4 and FIG. 5 are respective right side and rear views of the loader-side coupling structure partially engaged with the attachment side coupling structure.
Figure 5:
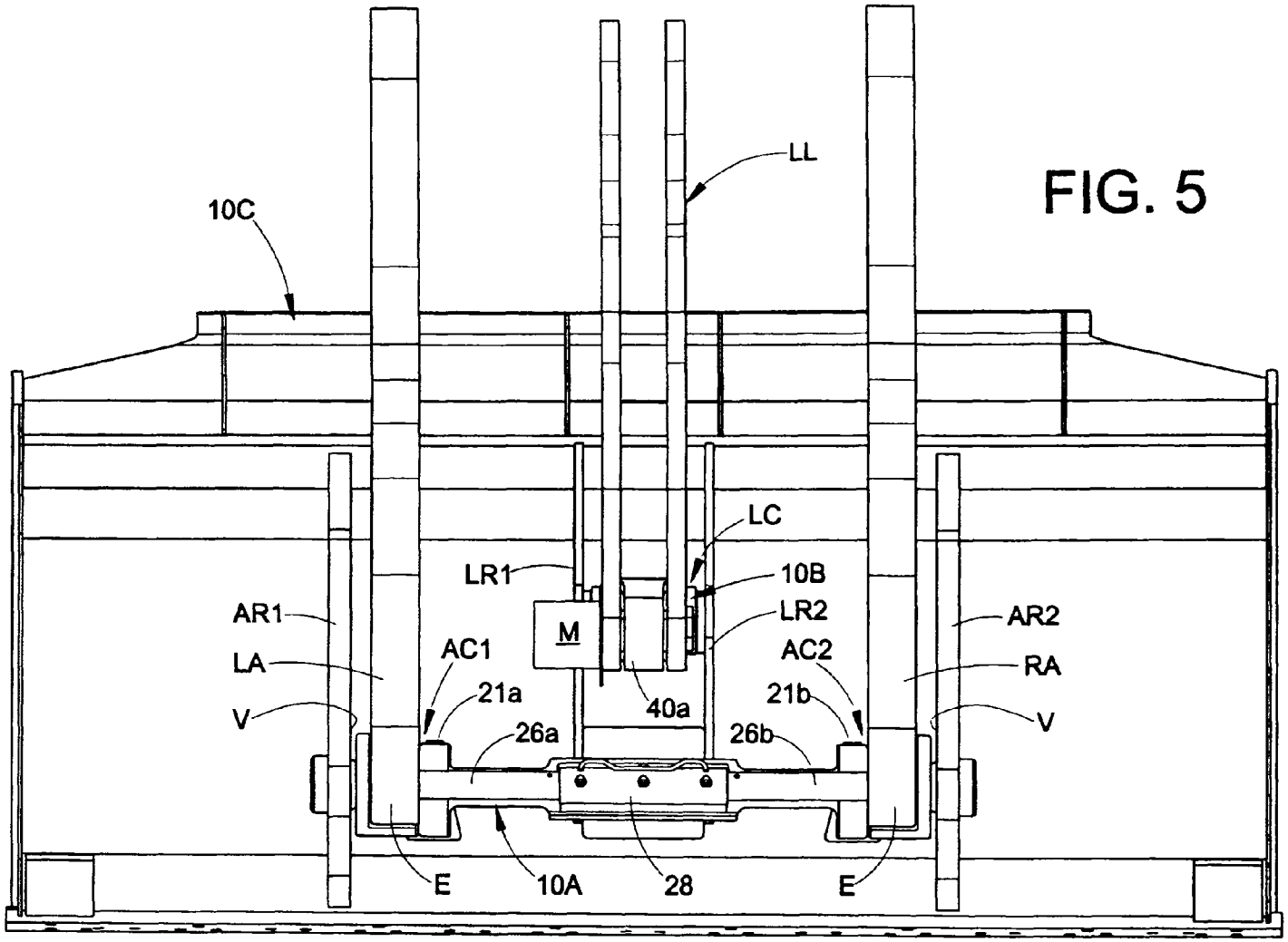
Figure 6:
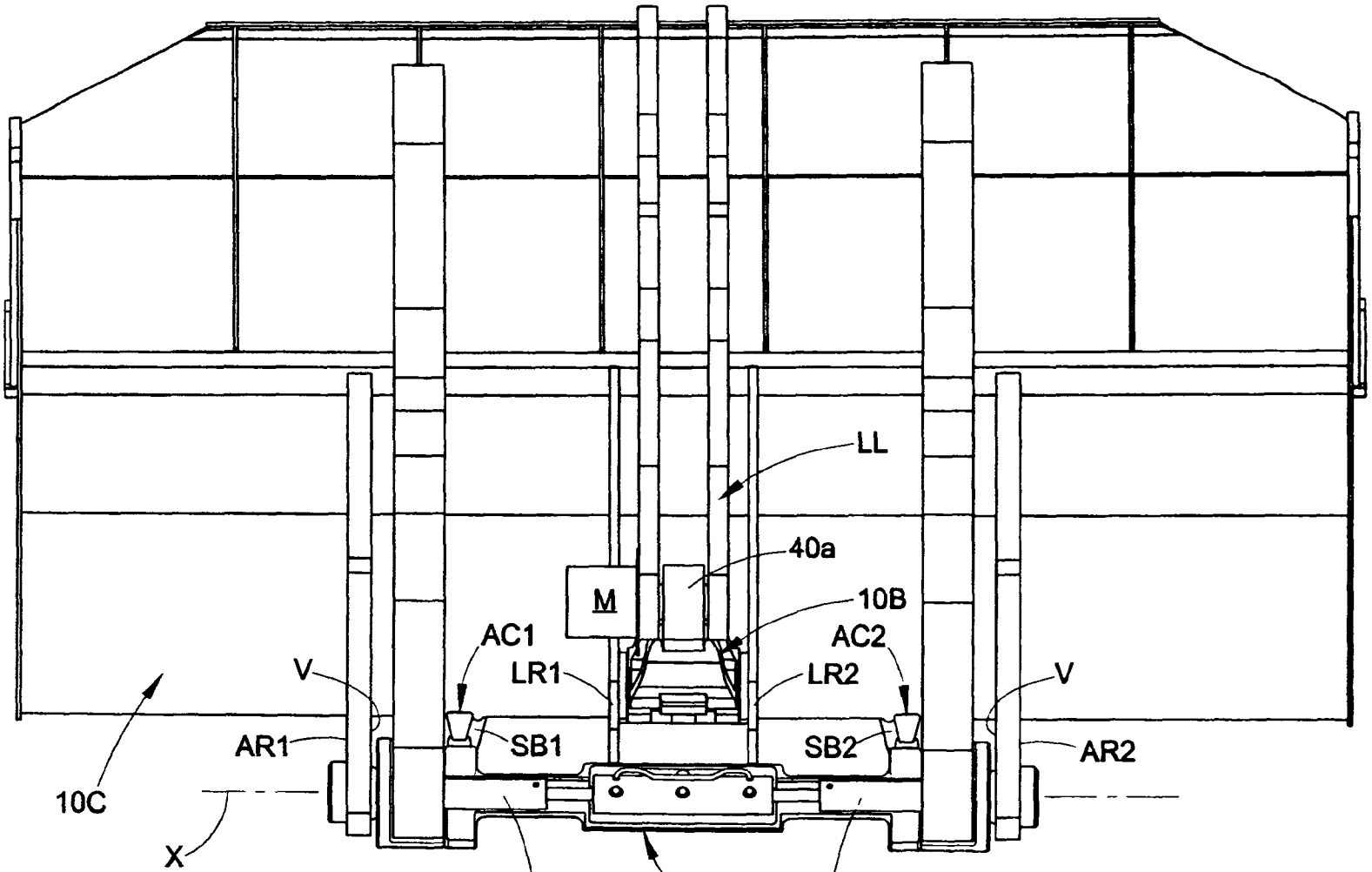
FIG. 6 is a rear view similar to FIG. 5, but shows the loader-side coupling structure fully engaged or mated with the attachment side coupling structure.

The loader-side coupling structure LQ selectively mates with and releasably engages the attachment-side coupling structure AQ of the attachment 10C to operably secure the attachment 10C to the loader arms LA,RA and control link LL for performing work with the attachment body AB. FIG. 4 (right side view) and FIG. 5 (rear view) show the loader-side coupling structure LQ partially engaged with the attachment side coupling structure AQ, i.e., with the arm coupler 10A abutted with the first and second arm coupling structures/locations AC1,AC2 but not captured or locked thereto, and with the link coupler 10B engaged with the link coupling structure/location LC but not captured or locked thereto. FIG. 6 is a rear view similar to FIG. 5, but shows the loader-side coupling structure LQ fully engaged or mated with the attachment side coupling structure AQ (see also FIG. 7 which is an isometric view corresponding to FIG. 6), i.e., the arm coupler 10A is captured/locked to the first and second arm coupling structures/locations AC1,AC2 of the attachment 10C, and the link coupler 10B is captured/locked to the link coupling structure/location LC of the attachment 10C.

Figure 7:
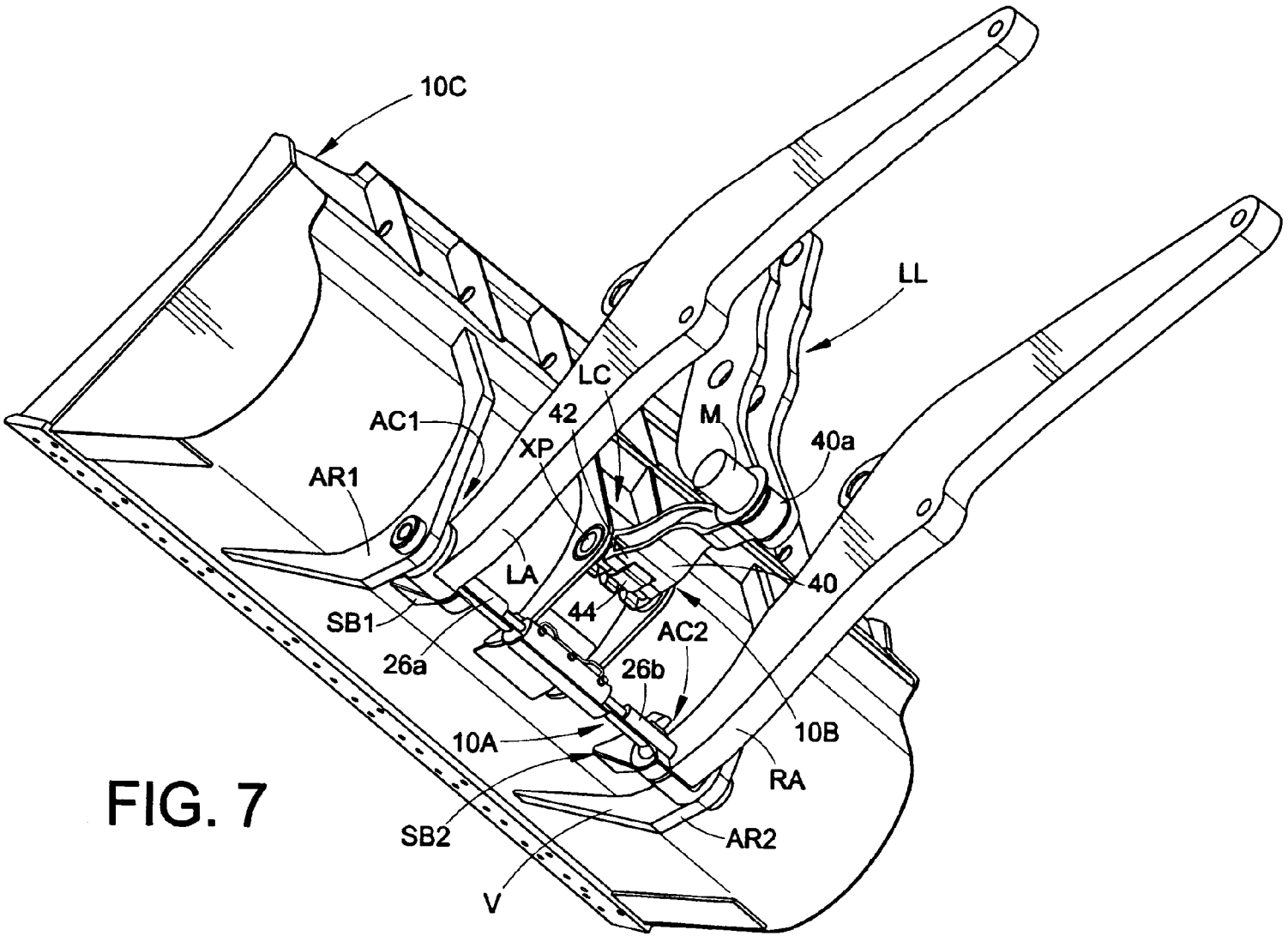
FIG. 7 is an isometric view corresponding to FIG. 6.
Figure 8:
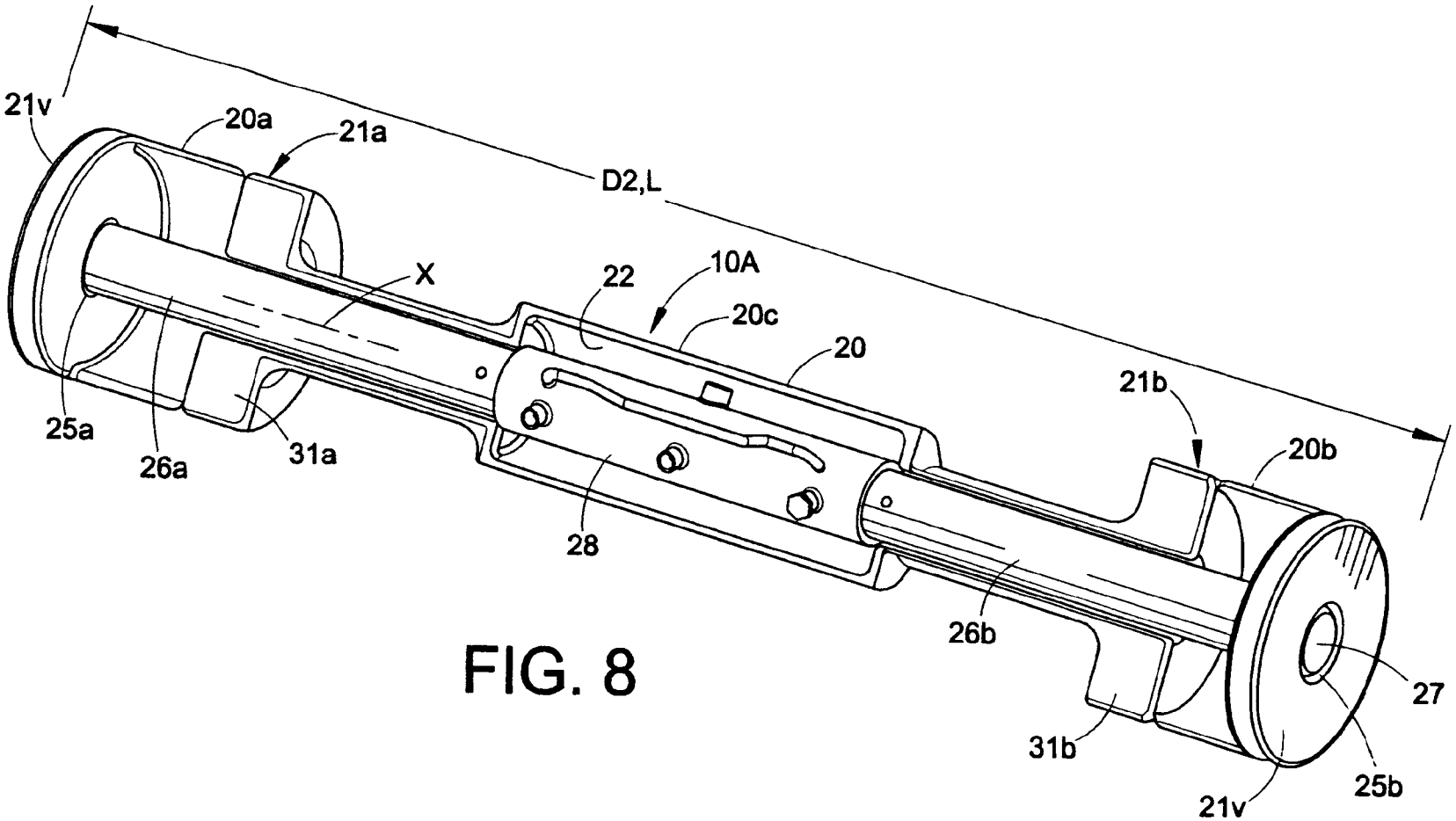
FIG. 8 is an isometric view of the arm coupler portion of the loader-side coupling structure, with the first and second plunger pins in their retracted positions.
Figure 9:
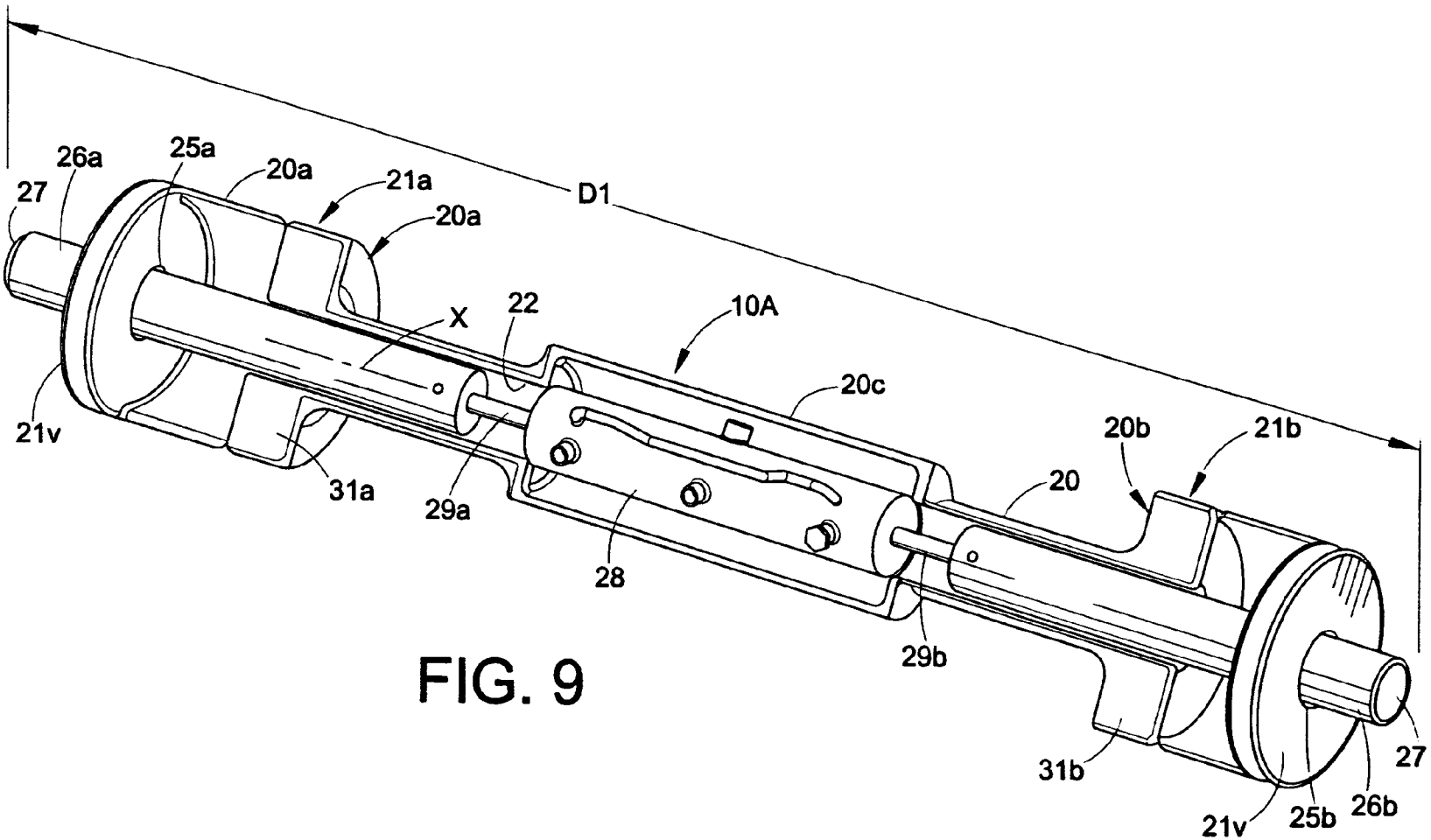
FIG. 9 is similar to FIG. 8 but shows the first and second plunger pins in their extended positions.
Figure 10:
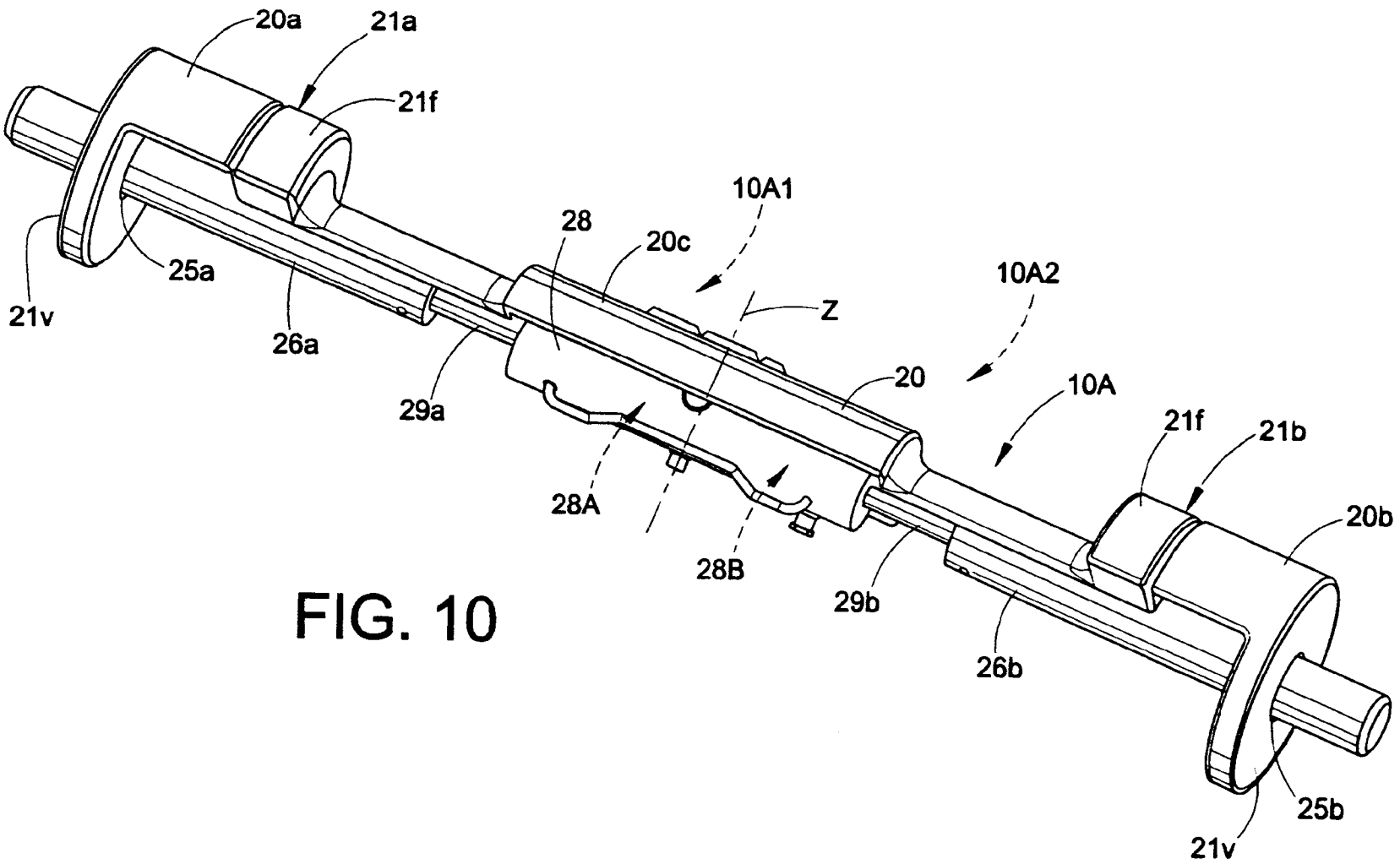
FIG. 10 is similar to FIG. 9 but provides an alternative isometric view of the arm coupler portion.

The arm coupler 10A is shown by itself in FIGS. 8-10. Referring to all of FIGS. 6-10, it can be seen that the arm coupler 10A comprises a body 20 permanently or releasably connected to the loader arms LA,RA and that extends between and interconnects the loader arms. In the illustrated embodiment, the body 20 comprises first (left) and second (right) ends 20*a*,20*b* connected by a central portion 20*c*. In the illustrated embodiment, the body 20 comprises a C-shaped cross-section with a concave rear face that defines a recess 22. The first and second body ends 20*a*,20*b* comprise respective first and second bosses or mounts 21*a*,21*b* each comprising a convex arcuate mount face 21*f* that is dimensioned and conformed with a radius that matches or corresponds to the radius of the stop faces SF of the attachment stop blocks SB1,SB2. The first and second body ends 20*a*,20*b* each further comprise a vertical end face 21*v* that is transverse to the arcuate mount face 21*f*. The vertical end faces 21*v* at the first and second body ends 20*a*,20*b* define respective plunger apertures 25*a*, 25*b*.

The arm coupler 10A further includes first (left) and second (right) cylindrical plunger pins 26*a*,26*b* located in the recess 22 at the first and second ends 20*a*,20*b*, respectively. The plunger pins are coaxially arranged on a locking axis X. At least one actuator, such as the illustrated dual-rod, double-acting hydraulic cylinder 28, is connected to the body 20 in the recess 22 between the plunger pins 26*a*,26*b* (the actuator 28 is sometimes referred to herein as a "plunger actuator"). The plunger actuator 28 comprises first and second rods 29*a*, 29*b* (FIG. 9) operably coupled to the first and second plunger pins 26*a*,26*b*, respectively. The actuator 28 is selectively pressurized with hydraulic fluid using known hydraulic components and systems to move each rod 29*a*,29*b* and the respective plunger pins 26*a*,26*b* to and between a retracted or unlocked position (FIG. 5 and FIG. 8) and an extended or locked position (FIGS. 6, 7, and 9). In the extended or locked position, the plunger pins 26*a*,26*b* project outwardly through the respective plunger apertures 25*a*,25*b* so as to project outwardly from the respective vertical end faces 21*v*, and such that a first distance D1 (FIG. 9) is defined between the respective outer ends 27 of the first and second plunger pins 26*a*,26*b*. In the retracted or unlocked position, the plunger pins 26*a*,26*b* are withdrawn into the recess 22 through the plunger apertures 25*a*,25*b* so as to be flush with or recessed relative to the respective vertical end faces 21*v*, and in this retracted/unlocked position, a second distance D2 (FIG. 8) less than the first distance D1 is defined between the respective outer ends 27 of the first and second plunger pins 26*a*, 26*b*. In FIG. 8, the distance D2 is equal to a length L of the body 20 owing to the fact that the ends 27 of the plunger pins 26*a*,26*b* are flush with the opposite first and second vertical end faces 21*v*. Thus, the first distance D1 is greater than a length L of the coupler body 20 as defined between the vertical end faces 21*v*, and the second distance D2 is less than or equal to a length L of the coupler body 20 as defined between the vertical end faces 21*v*.

Referring again specifically to FIGS. 5-7, those of ordinary skill in the art will understand that when the arm coupler 10A is mated with the attachment 10C so that its first and second mounts 21*a*,21*b* are seated respectively in the first and second arm coupling structures/locations AC1,AC2, the arcuate mount faces 21*f* of the arm coupler 10A are mated with the corresponding stop faces SF of the stop blocks SB1,SB2 and adapted for sliding movement relative thereto, and the vertical end faces 21*v* at the opposite ends of the arm coupler 10A are located closely adjacent the inner faces V of the arm ribs AR1,AR2, with minimal clearance between the end faces 21*v* and the respective rib inner faces V (and/or any bosses or the like protruding therefrom) so as to minimize relative lateral movement of the arm coupler 10A and attachment 10C, i.e., to prevent or at least minimize any movement of the attachment 10C along the locking axis X. Furthermore, when the arm coupler 10A is mated with the first and second arm coupling structures/locations AC1,AC2 of the attachment 10C and the plunger pins 26*a*,26*b* are extended into their locked positions, the plunger pins 26*a*,26*b* extend into the arm rib apertures AP1,AP2, respectively, with a close sliding fit to pivotally connect the arm coupler 10A to the arm ribs AR1,AR2 of the attachment 10C. Retraction of the plunger pins 26*a*,26*b* to their unlocked or retracted positions withdraws the plunger pins 26*a*,26*b* from the arm rib apertures AP1,AP2 to allow separation of the arm coupler 10A from the arm ribs AR1,AR2. If the attachment-side coupler structure AQ' is used, including hooks H1,H2, these hooks H1,H2 are received over and engage the body 20 of the arm coupler 10A when the arm coupler 10A is mated with the first and second arm coupling structures/locations AC1,AC2. Those of ordinary skill in the art will recognize that when the hooks H1,H2 engage the arm coupler body 20, this will facilitate proper alignment between the arm coupler 10A and the arm coupling structures/locations AC1,AC2 which will assist proper engagement of the plunger pins 26*a*,26*b* with the respective rib apertures AP1,AP2. In use, the hooks H1,H2 are engaged with the body 20 of the arm coupler 10A and serve to distribute loads more evenly when the attachment AB is being pulled or dragged rather than pushed.

Figure 11:
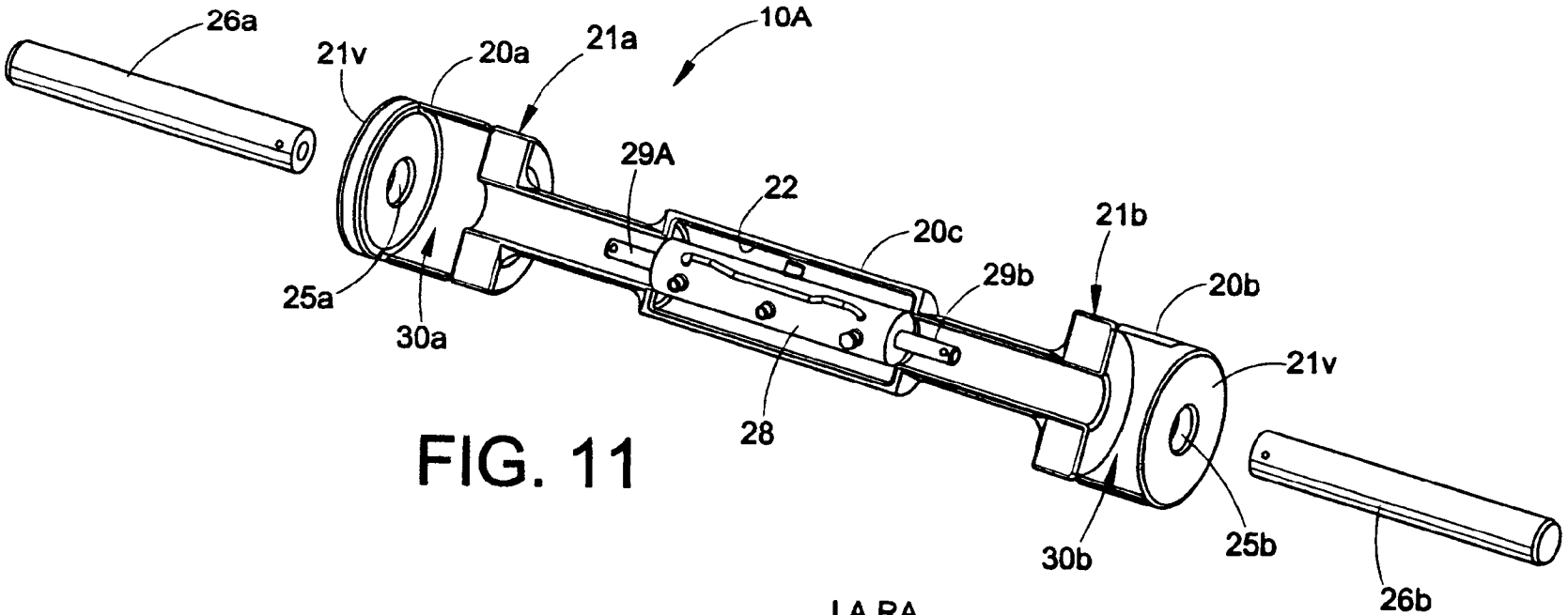
FIG. 11 is an isometric view of the arm coupler portion showing disconnection of the first and second plunger pins as required to operatively install the arm coupler portion to first and second loader arms.
Figure 11A:
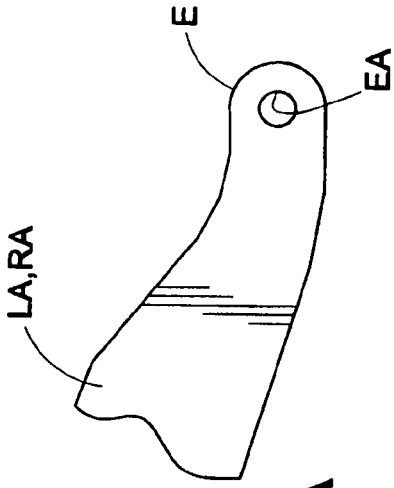
FIG. 11A is a partial side view that shows a conventional loader arm structure.

In the illustrated embodiment, the arm coupler 10A is releasably connected to the first and second loader arms LA,RA. With reference also to FIG. 11, the recess 22 of the body 20 at the opposite ends 20*a*,20*b* defines respective first and second loader arm receiving locations 30*a*,30*b* that are adapted to receive the ends of the first and second loader arms LA,RA, respectively. In order for the loader arms LA,RA to be fully received into the first and second loader arm receiving locations 30*a*,30*b*, the plunger pins 26*a*,26*b* must be separated from the respective rods 29*a*,29*b* of actuator cylinder 28 and be withdrawn from the recess 22, e.g., via sliding withdrawal through plunger apertures 25*a*,25*b* as shown in FIG. 11, to provide clearance thr insertion of the loader arms into the first and second loader arm receiving locations 30*a*,30*b*. Each loader arm LA,RA is defined as partially shown in FIG. 11A, with an end E including an arm aperture E. After the ends E of the loader arms LA,RA are inserted into the respective first and second loader arm receiving locations 30*a*,30*b*, the plunger pins 26*a*,26*b* are reinstalled by insertion through the plunger apertures 25*a*,25*b* of the arm coupler housing 20 and passage of the plunger pins 26*a*,26*b* into the coaxially located arm apertures E and finally sliding advancement of the plunger pins 26*a*,26*b* to a position where they are reconnected to the respective rods 29*a*,29*b* of the actuator 28. Once the plunger pins 26*a*,26*b* are reconnected to the rods 29*a*,29*b*, the plunger pins 26*a*,26*b* and the loader arms LA,RA are operatively captured to the housing 20 of the arm coupler 10A. It should be noted that it is preferred that, as shown, the plunger pins 26*a*,26*b* are supported by the coupler body 20 on both sides of the respective arm receiving locations 30*a*,30*b*, on one side by the vertical end faces 21*v* and on the other side by inner support walls 31*a*,31*b* through which the plunger pins 26*a*,26*b* extend. The inner support walls 31*a*,31*b* are respectively aligned with an strengthen the first and second mounts 21*a*,21*b* of the body 20.

In an alternative embodiment, the hydraulic locking cylinder 28 or other locking actuator of the arm coupler 10A can be provided by first and second separate independent cylinders 28A,28B (see broken lines in FIG. 10) that are operatively connected to the first and second plunger pins 26*a*,26*b*, respectively.

As seen, e.g., in FIGS. 2-7, the link coupler 10B comprises a tilt link 40 including a first (inner) end 40*a* that is pivotally connected to the loader control link LL and a second (outer) end 40*b* that is adapted to be selectively engaged with and captured to the link cross-pin XP. A hydraulic or electric motor M or other tilt link actuator such as a hydraulic cylinder or the like is connected to the loader control link LL and is drivingly connected to the first end 40*a* or other portion of the tilt link 40 and is selectively controllable to pivot the tilt link about a horizontal pivot axis relative to the control link LL to vary and control the angular position of the second end 40*b* of the tilt link under operator control of the loader hydraulic and/or electric system. In an alternative embodiment, the motor M is replaced with a spring or like mechanical biasing means such as a torsion spring that controls the angular orientation of the tilt link 40 relative to the control link.

Figure 12A:
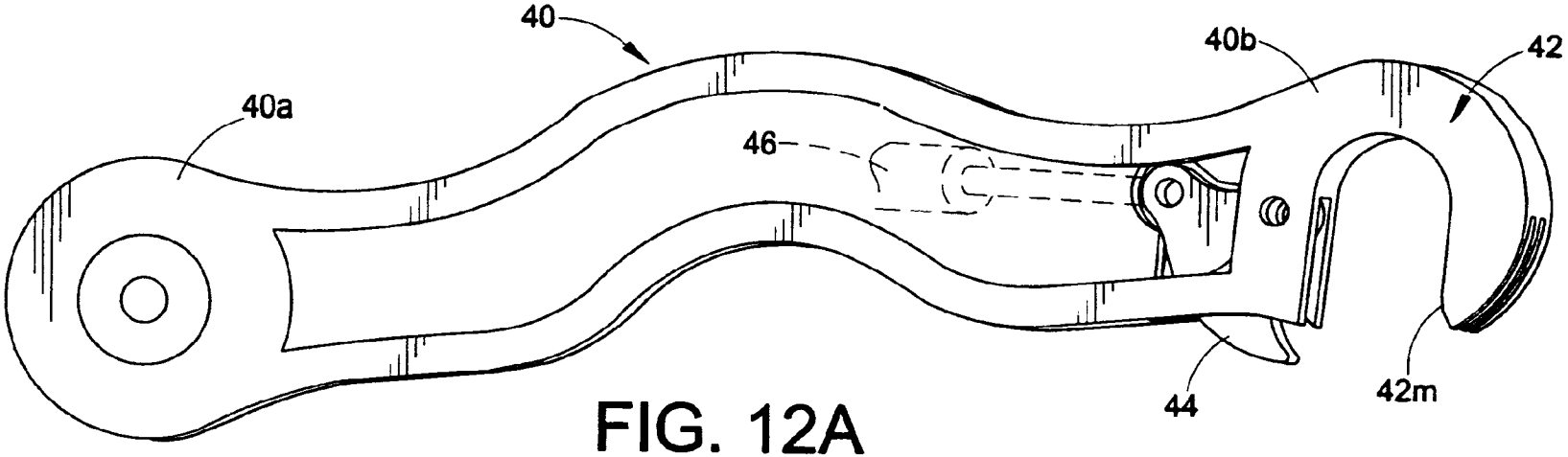
FIGS. 12A and 12B show a first embodiment of a tilt link portion of the link coupler with its lock system in unlocked and locked conditions, respectively.
Figure 12B:
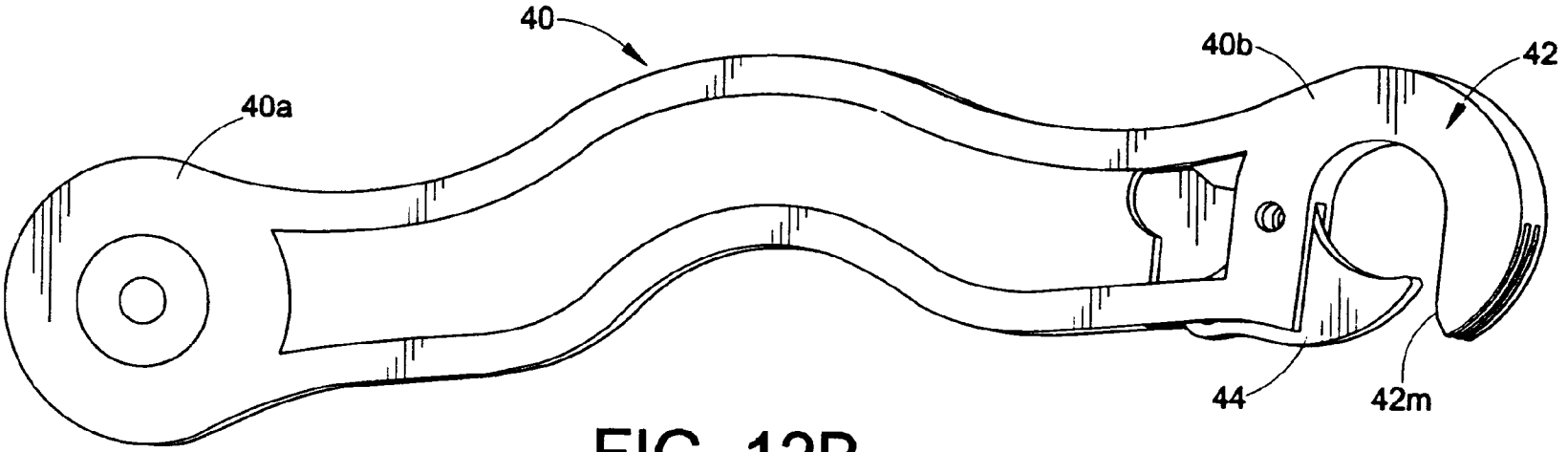

The tilt link 40 is shown by itself in FIGS. 12A and 12B. The second outer end 40*b* of the tilt link comprises means for selectively engaging the link cross-pin XP. In the illustrated embodiment, the second end 40*b* of the tilt link comprises a downwardly opening claw or hook 42 that is adapted to receive the cross-pin XP therein. The second end 40*b* of the tilt link further comprises a lock system for selectively capturing the cross-pin XP in the hook 42. In the illustrated example, the lock system comprises a pivoting or otherwise movable lock wedge or lock member 44 that is connected to the tilt link 40 but that is movable between an unlocked position (FIG. 12A) and a locked position (FIG. 12B). The term "lock member" as used herein is intended to encompass both a one-piece or multi-piece construction. In its unlocked position, the lock wedge 44 is withdrawn sufficiently relative to the mouth 42*m* of the hook 42 to allow the link cross-pin XP to move freely into and out of the hook 42. In its locked position, the lock wedge 44 is extended sufficiently relative to the mouth 42*m* of the hook 42 to obstruct the mouth 42*m* and capture the link cross-pin XP in the hook 42. As shown in broken lines in FIG. 12A only, the link coupler 10B further comprises a lock actuator such as a hydraulic cylinder 46 connected to the tilt link 40 and operatively engaged with the lock wedge 44 to selectively move the lock wedge 44 to and between its locked and unlocked positions. Alternatively, the lock wedge 44 can be connected by a linkage to the motor M so that the lock wedge 44 is moved to its locked position by the motor M after the motor pivots the tilt link 40 to a position where the link cross-pin XP is received into the hook 42. As noted above, the cross-pin XP can comprise a non-rotatable pin that extends between the link ribs LR1,LR2 and an external rotatable sleeve that is coaxially mounted about the non-rotatable pin. The rotatable sleeve can be a greased part or a never-grease type rotatable sleeve. Alternatively, the cross-pin XP is designed as a wear part, i.e., from a softer metal than the hook 42 of the tilt link 40 so that the easily replaceable cross-pin XP will wear faster while preserving the hook 42. The hook 42 can also optionally be lined with a replaceable sleeve that will wear and that can be replaced to protect the tilt link 40.

Figure 13A:
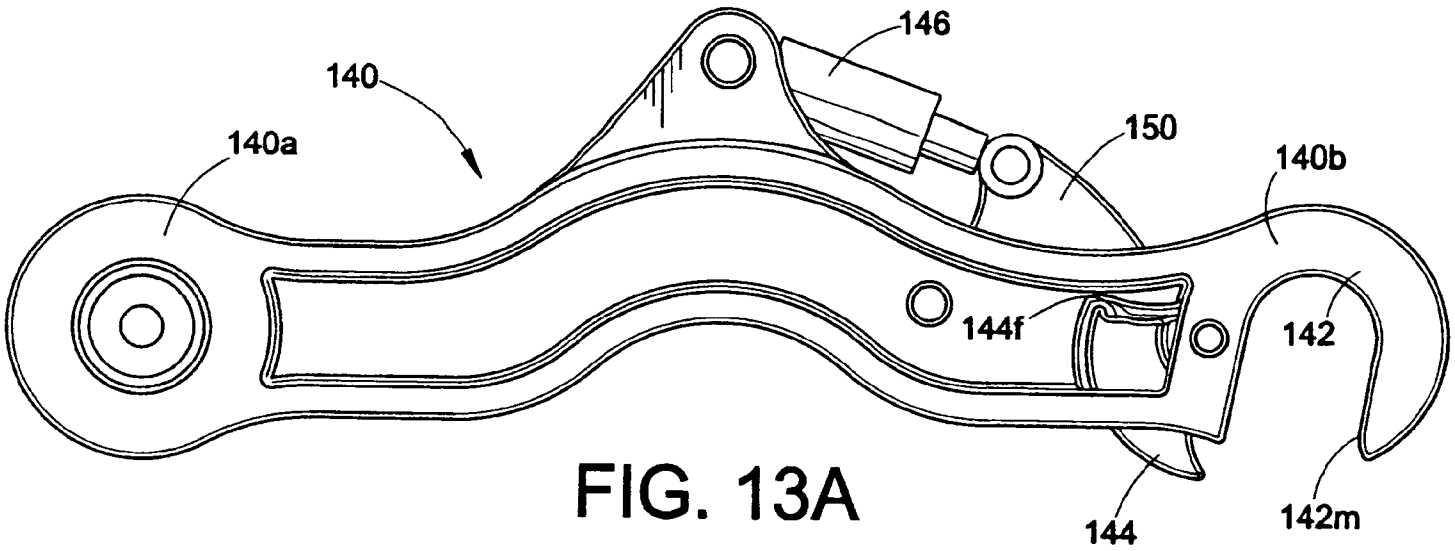
FIG. 13A shows a second embodiment of a tilt link portion of the link coupler with its lock system in an unlocked condition.
Figure 13B:
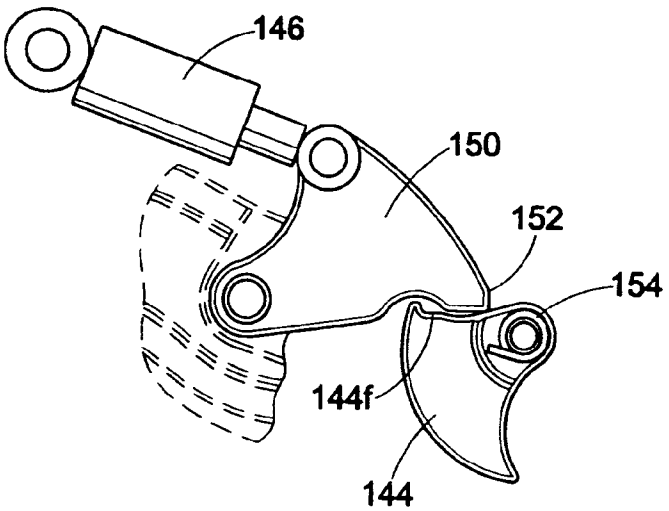
FIG. 13B is a partial view of the tilt link of FIG. 13A with portions broken away and shown in phantom lines to reveal additional structures.
Figure 14A:
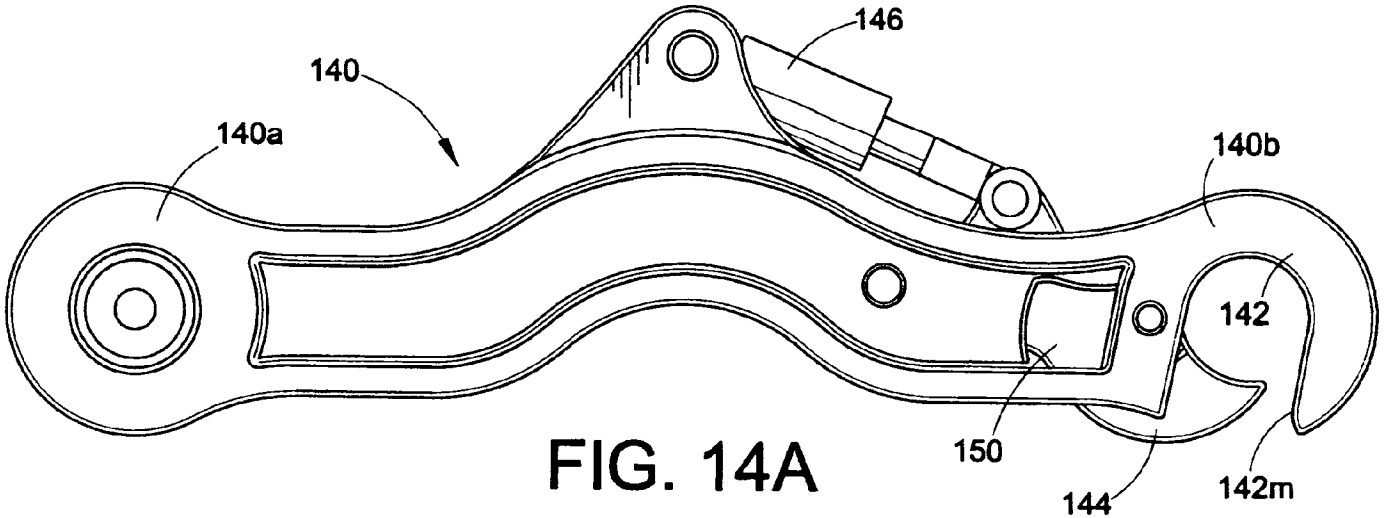
FIGS. 14A and 14B are respectively similar to FIGS. 13A and 13B but show the lock system in a locked condition.
Figure 14B:
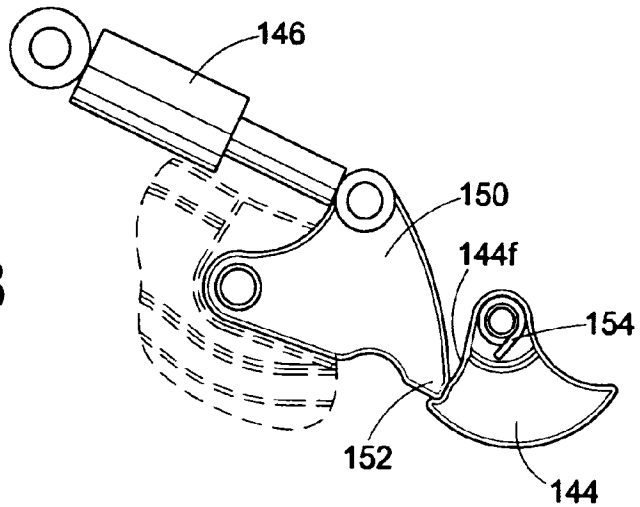

An alternative tilt link 140 is shown by itself in FIGS. 13A and 14A. Except as otherwise shown and/or described herein, the tilt link 140 is identical to the tilt link 40, and like components are referenced using numbers that are 100 greater than those used in FIGS. 12A and 12B. The second outer end 140*b* of the tilt link comprises means for selectively engaging the link cross-pin XP. In the illustrated embodiment, the second end 140*b* of the tilt link comprises a downwardly opening claw or hook 142 that is adapted to receive the cross-pin XP therein. The second end 140*b* of the tilt link further comprises a lock system for selectively capturing the cross-pin XP in the hook 142. In the illustrated example, the lock system comprises a pivoting or otherwise movable lock wedge/member 144 that is connected to the tilt link 40 but that is movable between an unlocked position (FIG. 13A) and a locked position (FIG. 14A). In its unlocked position, the lock wedge 144 is withdrawn sufficiently relative to the mouth 142*m* of the hook 142 to allow the link cross-pin XP to move freely into and out of the hook 142. In its locked position, the lock wedge 144 is extended sufficiently relative to the mouth 142*m* of the hook 142 to obstruct the mouth 142*m* and capture the link cross-pin XP in the hook 142. A lock actuator such as a hydraulic cylinder 146 is connected to the tilt link 140 and operatively coupled or associated with the lock wedge 144 to selectively move the lock wedge 144 to and between its locked and unlocked positions. FIGS. 13B and 14B correspond respectively to FIGS. 13A and 14A and show portions of the tilt link 140 removed to reveal additional structure and operation and control of the lock wedge 144. Instead of a direct connection between the lock actuator 146 and the lock wedge 144, an intervening cam 150 is provided for the operative coupling of the actuator and lock wedge. The cam 150 is pivotally or otherwise movably connected to the tilt link 140 and is operably connected to the lock actuator 146 such that the lock actuator 146 is selectively active to move the cam 150 between a retracted position (FIGS. 13A & 13B) and an extended position (FIGS. 14A & 14B). When the lock actuator 146 moves the cam 150 from its retracted position to its extended position, a lobe 152 of the cam engages a rear lock face 144*f* of the lock wedge 144 and urges the lock wedge from its unlocked position (FIGS. 13A & 13B) to its locked position (FIGS. 14A & 14B). The tilt link 140 includes lock wedge biasing means for biasing the lock wedge 144 to its unlocked position when the cam 150 is moved from its extended position to its retracted position. In the illustrated embodiment, the lock wedge biasing means comprises at least one torsion spring 154 located about the pivot axis of the lock wedge 144 and acting between the lock wedge and the outer end 140*b* of the tilt link to move the lock wedge to its unlocked position as shown in FIGS. 13A and 13B in the absence of the cam 150 acting on the lock wedge. The actuator 146 moves the cam 150 and lock wedge 144 to their extended/locked positions against the biasing force of the spring 154. The lobe 152 of the cam 150 and rear lock face 144*f* of the lock wedge are conformed and dimensioned and arranged such that when the cam 150 is extended and the lock wedge in its locked position, the lock wedge will be retained in its locked position upon loss of power or pressure in the lock actuator 146. Also, the presence of the cam 150 between the lock wedge 144 and actuator 146 ensures that threes from the coupled attachment 10C are not directly and fully transmitted to the lock actuator 146. In one embodiment, the cross-pin XP is non-rotatably captured in the hook 142 and, as such, the cross-pin XP includes a rotatable external sleeve that is engaged by the hook 142 and lock wedge 144 and that is coaxially mounted about a fixed pin so as to allow relative pivoting movement between the tilt link 140 and the attachment AB.

Unlike conventional loader couplers, the position of the hook 42,142 of the tilt link 40,140 is movable relative to the locking axis X such that the distance between the hook 42,142 and the axis X is variable. This allows for the loader side coupler LQ to mate with a variety of different attachment side coupler structures AQ each with a different spacing between the cross-pin XP and the arm attachment rib apertures AP1, AP2 thereof.

To couple the attachment 10C to a loader machine, the arm coupler 10A is typically first moved into abutment with the stop blocks SB1,SB2 and the hook 42,142 of the link coupler 10B is moved so that the cross-pin XP is received therein. The attachment 10C is then rolled-back (using the link coupler 10B) and, in response to a switch controlled by the operator, hydraulic pressure is supplied simultaneously to: (i) the actuator 28 to extend the plunder pins 26*a*,26*b* of the arm coupler 10A; and, (ii) the lock actuator 46,146 of the link coupler 10B to extend the lock wedge/member 44,144 (decoupling can be performed in the reverse order, typically also with simultaneous actuation of the arm coupler actuator 28 and link coupler actuator 46,146 to retract the plunger pins 26*a*,26*b* and lock wedge/member 44,144 in response to operator control).

Those of ordinary skill in the art will recognize the desire, in certain applications, for the attachment 10C to be coupled to the loader arms LA,RA and control link LL with zero deviation or offset relative to the loader machine OEM specified pin-on location for an attachment of the type and size of the attachment body AB. In such case, the location of each arm rib aperture AP1,AP2 and the location of the link cross-pin XP, and the configuration of the link coupler 10B and arm coupler 10A are conformed, dimensioned and/or arranged relative to each other such that when an attachment 10C is operatively coupled to the loader arms LA,RA and control link LL using the arm coupler 10A and link coupler 10B, the position and operation of the attachment body AB relative to a reference point on the arms LA,RA and/or control link LL (e.g., relative to the centers of the arm apertures E) is identical to the loader OEM specified pin-on geometry for a pin-on attachment including the same size and type of attachment body AB. In other applications, it is desirable to vary the geometry relative to the OEM specified pin-on location for an attachment of the size and type of the attachment body AB (e.g., for added break-out force or other performance attributes), in which case, the location of each arm rib aperture AP1,AP2 and the location of the link cross-pin XP, and the configuration of the link coupler 10B and arm coupler 10A are conformed, dimensioned and/or arranged relative to each other such that when an attachment 10C is operatively coupled to the loader arms LA,RA and control link LL using the arm coupler 10A and link coupler 10B, the position and operation of the attachment body AB relative to a reference point on the arms LA,RA and/or control link LL is altered as desired relative to the loader OEM specified pin-on geometry.

It is also important to recognize that the arm coupler 10A can be releasably connected to the loader arms LA,RA (as illustrated herein) or can alternatively be permanently affixed to the loader arms LA,RA as by welding or the like, and/or the loader arms LA,RA can be manufactured with the arm coupler 10A integral therewith. Furthermore, in the illustrated embodiment and such alternative embodiments, the arm coupler 10A can be provided as two separate and completely disconnected arm couplers as represented at 10A1 and 10A2 and by dividing line Z in FIG. 10. Such separate arm couplers 10A1,10A2 are connected to or integrated into the first and second loader arms LA,RA, respectively. Likewise, the link coupler 10B can be releasably connected to the control link LL as illustrated herein or can alternatively be permanently affixed to the control link LL as by welding or the like, and/or the control link can be manufactured with the link coupler 10B integral therewith, and the tilt link portion 40 thereof can be integrated into and/or formed as a one-piece construction with the control link LL, either in a fixed or pivoting relationship.

In an alternative embodiment, a zero offset loader coupling system formed in accordance with the present development omits the link coupler 10B and replaces it with a second arm coupler 10A (or a variation thereof as described herein). In other words, the loader-side coupling system LQ can comprise one arm coupler 10A as described above, or first and second arm couplers 10A with one arm coupler 10A carried by the loader arms LA,RA as described above and with the other arm coupler 10A carried by left and right arms or links that are positioned vertically above the left and right loader arms LA,RA, e.g., in an arrangement often referred to as a tool-carrier. In such case, the attachment 10C is structured to include the first arm coupling structure/location AC1 and the second arm coupling structure/location AC2 and, instead of the link coupling structure/location LC, the attachment 10C will include third and fourth arm coupling structures and locations that are structured similar and correspondingly to the first and second arm coupling structures/locations AC1, AC2, respectively, and that are positioned to mate with the second arm coupler 10A.

Also, in another alternative embodiment, the zero offset loader coupling system can comprise one or more arm couplers 10A without including the link coupler(s) 10B, and/or can comprise one or more link couplers 10B without including the arm coupler(s) 10A. In such case, for example, an arm coupler 10A can be used for operative connection of an attachment 10C to the loader arms LA,RA, while a conventional pin-on link or other connection can be used to operatively connect the attachment 10C to the control link LL or the like, or a link coupler 10B can be used for operative connection of an attachment 10C to the loader control link LL while a conventional pin-on or other connection is used to operatively connect the attachment 10C to the loader arms LA,RA.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An arm coupler for a loader machine, said arm coupler comprising:

a body adapted to be connected to and extend between associated first and second loader machine arms, said body comprising first and second mounts located respectively adjacent opposite first and second ends of the body, said first and second mounts comprising respective first and second convexly curved mount faces adapted to abut stop faces of respective first and second stop blocks of an associated attachment;

first and second plunger pins located respectfully at the opposite first and second ends of said body;

at least one plunger actuator operatively connected to the first and second plunger pins, said at least one plunger actuator selectively operative to move the first and second plunger pins between a retracted position and an extended position, said first and second plunger pins projecting outward from the respective first and second opposite ends of the body a greater distance in the extended position as compared to the retracted position, wherein the first and second plunger pins are adapted to extend into apertures defined in first and second arm attachment ribs of the associated attachment, respectively, when the first and second plunger pins are located in the extended position;

wherein said first and second plunger pins are coaxially located on a locking axis and move on said locking axis between their retracted and extended positions;

said body further comprising first and second loader arm receiving locations located respectively between said at least one plunger actuator and said first and second opposite ends of said body that are adapted to receive first and second ends of the associated first and second loader machine arms, respectively, wherein said first and second plunger pins extend on said locking axis respectively through said first and second loader arm receiving locations and said first and second plunger pins are adapted to extend through and be slidably engaged with respective arm apertures defined in the associated first and second loader machine arm ends to capture the associated first and second loader machine arm ends in the first and second loader arm receiving locations, respectively, when said first and second plunger pins are located in and move between both said retracted and extended positions.

2. The arm coupler as set forth in claim 1, wherein the body comprises first and second vertical end faces located respectively at the opposite first and second ends of the body, each of said first and second vertical end faces comprising a plunger aperture, wherein the first plunger pin extends through the plunger aperture of the first vertical end wall and the second plunger pin extends through the plunger aperture of the second vertical end wall when the first and second plunger pins are located in their extended positions.

3. The arm coupler as set forth in claim 2, wherein an outer end of the first plunger pin is flush with or recessed relative to the first vertical end wall and an outer end of the second plunger pin is flush with or recessed relative to the second vertical end wall when the first and second plunger pins are located in their retracted positions.

4. The arm coupler as set forth in claim 1, wherein said at least one plunger actuator comprises a single plunger actuator operatively connected to both the first and second plunger pins.

5. The arm coupler as set forth in claim 4, wherein said single plunger actuator comprises a dual-rod, double-acting hydraulic cylinder supported by the body and comprising first and second rods that extend and retract and that are respectively connected to the first and second plunger pins.

6. The arm coupler as set forth in claim 4, wherein said at least one plunger actuator comprises first and second separate plunger actuators operatively connected respectively to the first and second plunger pins.

7. A coupler for connecting an attachment to associated loader machine arms, said coupler comprising:

a body adapted to be connected to and extend between first and second spaced-apart arms of an associated loader machine;

first and second plunger pins located respectfully at opposite first and second ends of said body;

at least one plunger actuator operatively connected to the first and second plunger pins, said at least one plunger actuator selectively operative to move the first and second plunger pins between a retracted position and an extended position, said first and second plunger pins projecting outward from the respective first and second opposite ends of the body a greater distance in the extended position as compared to the retracted position, wherein the first and second plunger pins are adapted to extend into apertures defined in first and second arm attachment ribs of the associated attachment, respectively, when the first and second plunger pins are located in the extended position;

said body further comprising first and second loader arm receiving locations located respectively between said at least one plunger actuator and said first and second opposite ends of said body and adapted to receive first and second ends of the first and second loader arms of the associated loader machine, respectively, wherein said first and second plunger pins extend respectively through said first and second loader arm receiving locations and said first and second plunger pins are adapted to extend through and be slidably engaged with arm apertures defined in the first and second loader arm ends in order to capture the first and second loader arm ends in the first and second loader arm receiving locations when said first and second plunger pins are located in both said retracted and said extended positions.

* * * * *